United States Patent [19]

Chandler

[11] Patent Number: 5,002,319

[45] Date of Patent: Mar. 26, 1991

[54] SHEET METAL LATCH APPARATUS

[75] Inventor: Kirk R. Chandler, Garland, Tex.

[73] Assignee: Rockwell International Corporation, El Segundo, Calif.

[21] Appl. No.: 574,188

[22] Filed: Aug. 28, 1990

[51] Int. Cl.[5] ..... E05C 19/06

[52] U.S. Cl. ..... 292/17; 292/310; 292/DIG. 53

[58] Field of Search ..... 174/51; 292/17, 19, 292/76, 77, DIG. 30, DIG. 38, DIG. 53, 251.5, 337

[56] References Cited

U.S. PATENT DOCUMENTS

| | | | |
|---|---|---|---|
| 853,272 | 5/1907 | Stodden | 292/17 |
| 1,550,621 | 8/1925 | Lawton | 292/17 |
| 1,809,406 | 6/1931 | Ferris | 292/17 |
| 2,794,664 | 6/1957 | Kruger | 292/DIG. 4 X |
| 3,747,975 | 7/1973 | McGregor | 292/202 X |
| 3,791,096 | 2/1974 | Epperlein | 292/17 X |
| 3,992,897 | 11/1976 | Loos | 174/51 X |

FOREIGN PATENT DOCUMENTS

| | | | |
|---|---|---|---|
| 872129 | 6/1971 | Canada | 292/17 |
| 2319302 | 10/1974 | Fed. Rep. of Germany | 292/17 |
| 176293 | 6/1933 | Switzerland | 292/17 |
| 187313 | 1/1937 | Switzerland | 292/17 |

*Primary Examiner*—Richard E. Moore

*Attorney, Agent, or Firm*—Bruce C. Lutz; V. Lawrence Sewell; H. Fredrick Hamann

[57] ABSTRACT

A combination latch and handle which comprises an L-shaped piece of deformable plastic material having a pocket intermediate two locking protrutions. The pocket, which holds a spring metal clip, fits into a slot on the edge of a piece of sheet metal. The locking protrusions pass through openings on either side of the slot to lock the latch and handle into place securely as the forces to install same are at right angles to the forces to engage or disengage the latching mechanism. The spring metal clip is designed to co-act with a pin on a mating piece of sheet metal.

8 Claims, 2 Drawing Sheets

FIG. 1
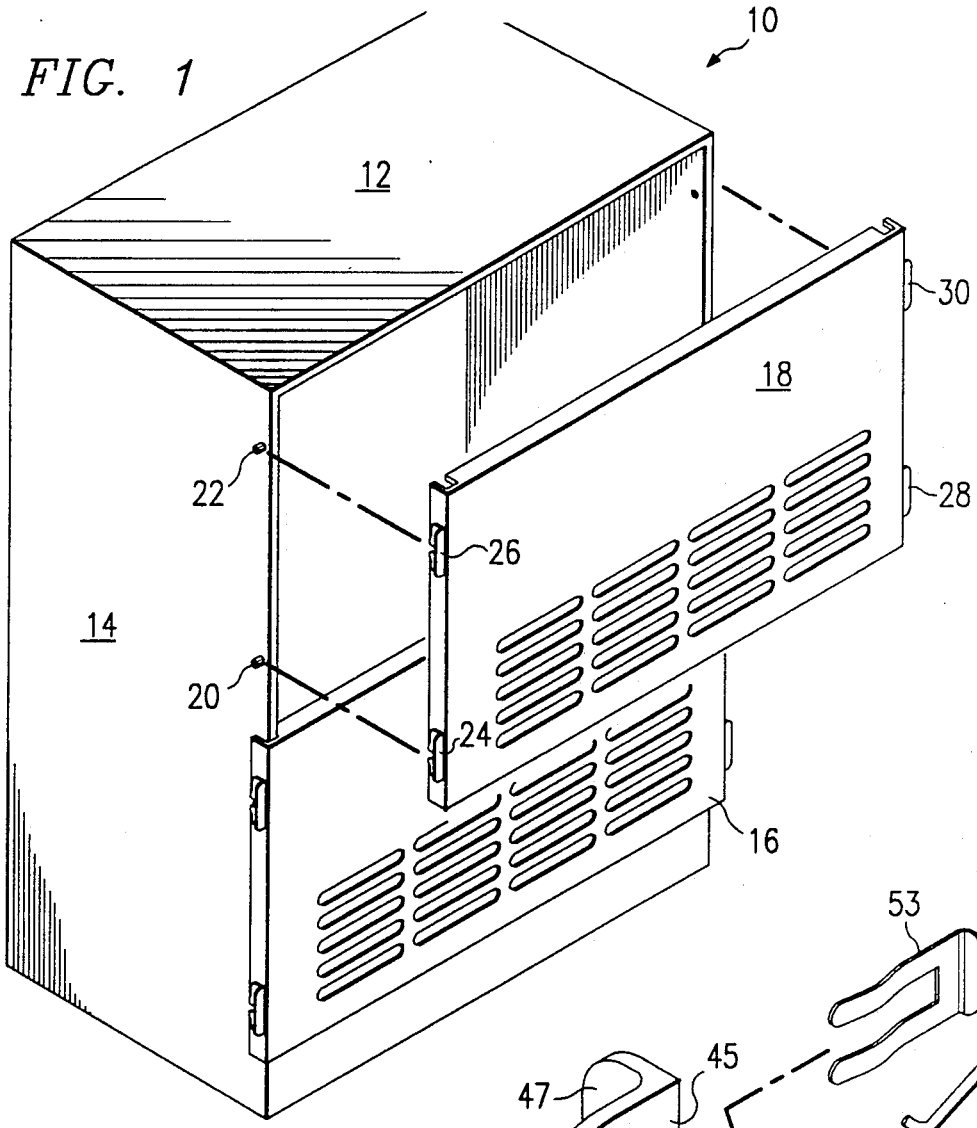
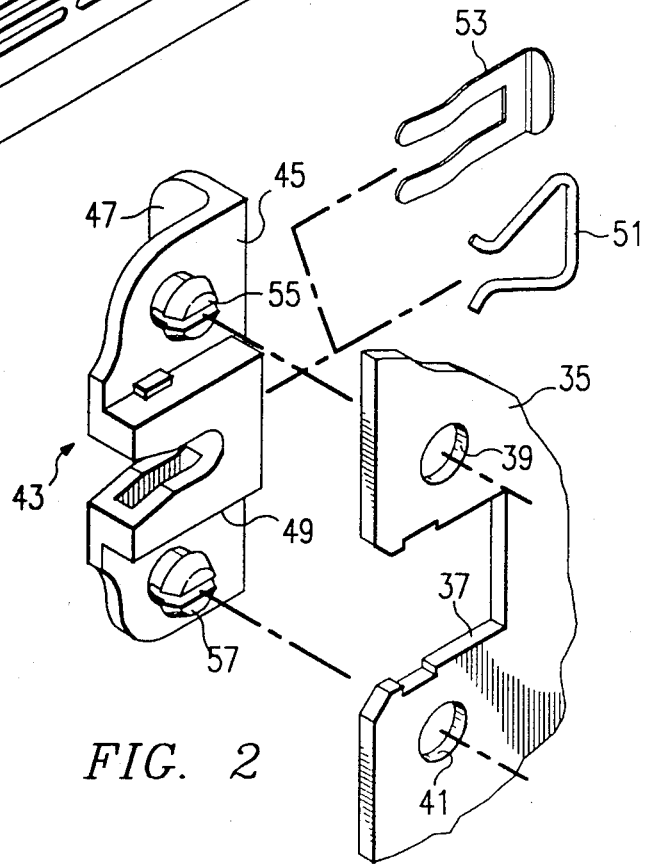
FIG. 2

FIG. 3
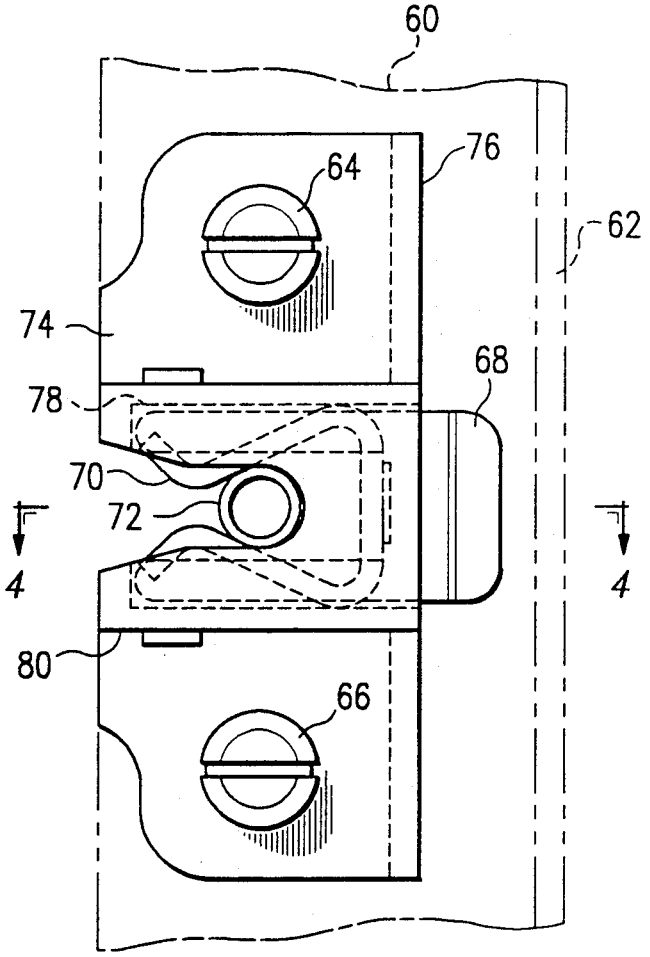
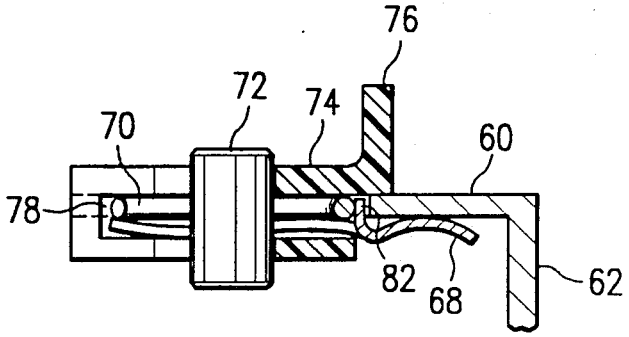
FIG. 4

SHEET METAL LATCH APPARATUS

THE INVENTION

The present invention is generally concerned with a combination latch and handle and, more specifically, is concerned with a latch which locks securely in place to a sheet metal cover or base. An added feature of the present invention is the ability to provide an electrical ground connection between the two pieces of sheet metal being attached through the use of the latch mechanism.

BACKGROUND OF THE INVENTION

Prior to the present invention, a deformable plastic insert, having a pocket containing a spring metal clip, was forced into an irregular shaped slot on the edge of a piece of sheet metal in the form of a cover. The irregularities in the slot provided the retention capability and the spring clip co-acted with a pin on a mating piece of sheet metal. To help disengage one piece of sheet metal from the other, handles were welded to the sheet metal containing the insert. However, when the cover was removed from the mating portion of the assembly, the pulling action sometimes caused the sheet metal to bow thereby allowing the sheet metal slot to distort enough whereby the deformable plastic would disengage from the sheet metal cover and remain engaged with the mating pin.

The accidental loss of the insert has been solved by the present invention in using locking extensions which can be forced through openings on either side of the slot and due to the high shear resistance of the protrusions (right angle disengagement forces), prevent accidental disengagement of the spring retaining pocket upon disengagement of the latch. By making the latch mechanism in an L-shape, a handle is provided to eliminate the added labor and material costs of welding handles to the sheet metal cover.

It is thus an object of the present invention to provide an improved latch mechanism which will not accidentally disengage when the sheet metal is distorted and which provides a built-in handle to assist in disengaging the latch.

Other objects and advantages will be apparent from the reading of the specifications and appended claims in conjunction with the drawings wherein:

FIG. 1 is an isometric view of a cabinet having two covers incorporating the inventive concept;

FIG. 2 is an exploded view of the latch mechanism;

FIG. 3 is a plan view of the deformable latch from the inside of a sheet metal cover;

FIG. 4 is a cross-sectional view of FIG. 3.

DETAILED DESCRIPTION

In FIG. 1 a base or rack generally designated as 10 has a top surface 12 and a side surface 14. A cover designated as 16 is shown attached to base 10 and a cover 18 is shown positioned away from base 10. On side 14 of base 10, pins 20 and 22 are illustrated which co-act with latch mechanisms 24 and 26, respectively, on one side of cover 18. The handle portion of further latches 28 and 30 are illustrated at the opposite end of cover 18. While not numerically designated, further latch handles can be observed on cover 16.

In FIG. 2 a piece of sheet metal 35 is illustrated with a notch or slot 37 and openings 39 and 41 positioned on either side of slot 37 and extending therethrough. A latch is generally designated as 43 and contains a elongated base 45 and an ear 47. A pocket 49 includes space for a spring clip means 51 which typically would be made of metal for grounding purposes but could be made of other elastic-type material. In addition, a metal grounding clip 53 is shown which fits in the pocket 49 along with spring clip 51. Deformable locking protrusions 55 and 57 are designed to engage the openings 39 and 41 on either side of slot 37 in sheet metal 35. The entire latch 43 is deformable so as to be positioned in the slot 37 and locked into place with the protrusions 55 and 57. As will be further noted in observing the remaining figures, when the latch 43 is in position, the spring clip 51 is aligned with the edge (thickness) of the sheet metal 35. It will be thus noted that, to disengage the latch insert 43 from sheet metal 35, forces coaxial with openings 39 and 41 are required or, in other words, at right angles to the surfaces of the sheet metal 35 whereas the forces of disengagement between the clip 51 and a pin such as 22 is in line with the sheet metal 35 and thus at right angles to the axis of the opening 39. Since the disengaging forces of the clip are at right angles to the engagement or disengagement forces between the insert and the sheet metal, the latch mechanism cannot be accidentally dislodged from the sheet metal cover.

In FIG. 3, an edge of a sheet metal cover is given a designation of 60 with the main portion of the cover given a designation of 62. It will be noted that the sheet metal is shown in phantom presentation in FIG. 3 so as to show as much as possible of the inventive device in solid lines. A deformable protrusion is designated as 64 and corresponds to protrusion 55 of FIG. 2. A similar protrusion 66 corresponds to protrusion 57. A ground clip 68 corresponds to ground clip 53 of FIG. 2 and provides a contact with the sheet metal surface 60. A spring clip generally in a U-shape form is designated as 70 and it is engaging a pin 72. The attachment of pin 72 to further sheet metal is not shown but it would be attached in a manner similar to that shown in FIG. 1. An elongated base of the latch mechanism is designated as 74 and corresponds to 45 of FIG. 2. A dash line in FIG. 3 is used to help represent the handle 76 corresponding to handle 47 of FIG. 2. The grounding clip 68 and the spring clip 70 are contained in a pocket shown in outline form as 78. Although not shown clearly because of the presentation, the exterior surfaces of pocket 78 fit within a slot 80 corresponding to slot 37 of FIG. 2.

FIG. 4 uses the same designators as used in FIG. 3. In addition, it will be noted from FIG. 4 that a lip 82 on the grounding clip 68 prevents the spring clip 70 from falling out of the pocket of base 74 when the latch mechanism is not attached to a sheet metal cover. Additionally, there is friction between the spring clip 70, the grounding clip 68 and the interior surfaces of the pocket of the latch base 74 to hold the spring clip in place when a device is not attached to the sheet metal. When it is attached as shown, the latch mechanism engagement forces shove the spring clip and the grounding clip 70 and 68 respectively against the edge of the insert shown as 37 in FIG. 2.

OPERATION

While the operation of the inventive concept is believed obvious from the detailed description, a few supportive comments will be provided. The part 43 in a preferred embodiment of the inventive concept is made of a deformable plastic with the pocket 78. The spring clip 51 along with the grounding clip 53 are inserted in the pocket 78. The dimensions of the pocket along with the springiness of ground clip 53 keeps the two parts wedged in the pocket. To attach the part 47 to the sheet metal 35, the ground clip 53 is first inserted through the slot 37 to one side of the sheet metal while the main part of the plastic piece 43 is on the opposite side. The base 45 of part 43 is then distorted slightly so as to force the tabs 55 and 57 through openings 39 and 41. The result will be a configuration such as shown in FIGS. 3 and 4 with the ground clip 53 making contact between the metal 60 and the spring clip 70 of FIG. 4. Since the spring clip 70 is also in contact with the pin 72, there is electrical connection from the metal chassis to the pin 72 which would typically be mounted in the metal of a base cabinet such as 10 of FIG. 1. In other words, pin 72 of FIG. 4 would be any of the pins in FIG. 1 as pins 20 or 22.

To attach cover 18 to base 10, the cover 18 is aligned such that the slots in the latch means 24 through 28 are aligned with the appropriate pins such as 20 and 22 and the cover 18 is pressed into place. The spring clips 51 expand temporarily to accommodate the pins such as 22 and the cover 18 is held firmly in place. To disengage the cover 18, the handles such as represented by your 47 in FIG. 2 may be grabbed to provide additional leverage to disengage the clip 51 from the pin 22. The disengagement can be one pin at a time if the cover 18 is distorted or can be the top two pins and then the bottom two pins since the design allows some pivoting action on the pins that are engaged.

Although the preferred embodiment uses a ground clip such as 53 to provide grounding between the two metal parts being attached, the grounding clip 53 canbe dispensed with and still practice the inventive concept by merely making the pocket 78 of such a dimension that the clip 51 does not fall out. Further, although the clip 51 is typically of metal for durability and the previously mentioned electrical grounding, if grounding is not important, the clip 51 may alternatively be some other material such as plastic. It will also be apparent that the part 43 could be molded of deformable plastic and eliminate the spring clip 51 and the grounding clip 53 entirely and merely design the pocket portion 49 in such a manner that it can deform and accommodate the pin 22 upon engagement. While a deformable plastic version would not be as durable as the version shown, it would operate in accordance with the teachings of this invention to provide a simple mechanism as a combination latching means and handle to simplify removal of the cover 18 without the problem of separate handles and the problem of loss of the latch with distortion of the cover 18.

While I have described a single preferred embodiment of the inventive concept, I wish to be limited not by the invention as specifically shown and discussed, but rather by the scope of the appended claims wherein I claim:

1. Combination handle and retaining apparatus for use in attaching a panel cover to an enclosure comprising, in combination:

a deformable base comprising first and second portions situated at right angles one with respect to the other wherein the first portion is adapted to be used with and situated contiguous a panel having first and second openings therein and having a slot between said first and second openings and said second portion is adapted to be used as a handle for use in handling the panel;

first and second locking projection means on said first portion, adapted to pass through said first and second openings in the panel, for locking said base to said panel;

a U-shaped spring metal clip; and slotted projection means on said first portion, enclosing said U-shaped metal clip means and adapted to engage said slot in the panel, for engaging a metal pin on an enclosure.

2. Apparatus as claimed in claim 1 where the panel and the enclosure are metal comprising, in addition:

grounding clip means, incorporated in said slotted projection means, for ensuring contact between said spring metal clip and the panel to ensure said panel and said enclosure are at the same electrical potential.

3. Electronic container and cover panel retaining apparatus comprising, in combination:

a container having a plurality of sides and an opening defined by edges of said sides;

a plurality of pins extending outwardly from the sides of the container near said edges;

a cover panel having a main portion and edge surfaces at opposite ends thereof extending at right angles to said main portion, said main portion being of a size to span said opening of said container with edge surfaces contiguous the sides of said container;

at least one slot in the edge surface at each of said opposite ends of said panel in the vicinity of said pins on said container;

an opening on each side of each of said slots;

U-shaped clip means for coacting with said pins to restrain changes between engagement and disengagement; and deformable plastic insert, means situated in each of said slots and having deformable locking projections extending through the opening on each side of the slot to hold the insert in place, for containing said U-shaped clip means in a manner whereby said clip means remains with said panel upon disengagement of said panel from said container and provides electrical contact between said container and said panel when said clip means is engaging one of said pins.

4. Apparatus as claimed in claim 3 comprising in addition an ear extending outwardly from said deformable plastic insert to be used as a handle to facilitate disengagement of said panel from said container.

5. Combination latch and handle apparatus comprising, in combination:

elongated base means, of deformable elastic material and having first and second opposing faces each extending from a first end of said base means to a second end, for mounting on a first member;

ear means, extending from said first face of said base means, for use as a pin disengaging handle of said first member;

a pocket portion, including a pin engaging slot, located intermediate the ends of said base means and extending from the second face of said base means for engagement with a suitable slot in the first member;

metal spring clip means, situated in the pocket portion of said base means, for detachably engaging a pin like structure of a second member; and first and second deformable locking protrusions situated on either side of said pocket portion and extending from said second face of said base means for engaging similar shape openings on either side of said pocket portion.

6. Apparatus as claimed in claim 5 comprising, in addition:

ground clip means situated in the pocket portion of said base means and extending outwardly therefrom to electrically connect the clip means with the first member when said first member is attached to the second member.

7. Latching apparatus insert for use on the edge of a sheet metal panel having a slot intermediate two further openings to detachably secure the panel to an extended pin comprising, in combination:

an elongated base of deformable plastic material and having first and second opposing faces each extending from a first end of said base to a second end;

ear means, extending from said first face of said base means, for use as a latch disengaging handle;

a pocket portion, including a pin engaging slot, located intermediate the ends of said base and extending from the second face of said base for engagement with a sheet metal slot;

metal spring clip means, situtated in the pocket portion of said base, for detachably engaging a pin like structure; and first and second deformable locking protrustions situated on either side of said pocket portion and extending from said second face of said base means for engaging similar shape openings in a sheet metal panel.

8. Combination latch and handle apparatus comprising, in combination:

elongated base means, of deformable elastic material and having first and second opposing faces each extending from a first end of said base means to a second end, for mounting on a first member, said first member being adapted for detachably engaging a pin like structure of a second member;

ear means, extending from said first face of said base means, for use as a pin disengaging handle of said first member;

a slot engaging portion, including a pin engaging deformable slot, located intermediate the ends of said base means and extending from the second face of said base means for engagement with a suitable slot in the first member;

first and second deformable locking protrusions situated on either side of said slot engaging portion and extending from said second face of said base means for engaging similar shape openings on either side of said slot engaging portion.

* * * * *